US008490633B1

(12) United States Patent
Kennedy et al.

(10) Patent No.: US 8,490,633 B1
(45) Date of Patent: Jul. 23, 2013

(54) FORCED AIR HAIR CURLER KIT

(76) Inventors: Nona J. Kennedy, Plantation, FL (US); Amy Morin, Plantation, FL (US)

( * ) Notice: Subject to any disclaimer, the term of this patent is extended or adjusted under 35 U.S.C. 154(b) by 0 days.

(21) Appl. No.: 12/781,991

(22) Filed: May 18, 2010

(51) Int. Cl.
*A45D 6/06* (2006.01)

(52) U.S. Cl.
USPC ..... 132/228; 34/96

(58) Field of Classification Search
USPC ..... 132/226, 227, 228, 229, 237, 238; 219/227–229; 34/96–101
See application file for complete search history.

(56) References Cited

U.S. PATENT DOCUMENTS

| | | | | |
|---|---|---|---|---|
| 3,444,624 | A | 5/1969 | Greenlee | |
| 3,990,460 | A | 11/1976 | Shalvoy | |
| 4,409,998 | A | 10/1983 | Bauer | |
| 4,721,122 | A | 1/1988 | Sahm | |
| 4,809,444 | A | 3/1989 | Henderson et al. | |
| 4,936,027 | A * | 6/1990 | Tsuji | 34/90 |
| 2005/0178400 | A1 * | 8/2005 | Fung | 132/228 |

* cited by examiner

*Primary Examiner* — Rachel Steitz

(57) ABSTRACT

A forced air hair curler kit for forming multiple individual curls, the kit including a housing which houses a motor, a fan, and a pair of heating elements therein, two different types of support bodies that attach to a housing front end, and two versions of attachment members each of which fit onto a different one of the support body types, the attachment members having alternating rows of air outlet holes through which heated airflow exits and rows of cone-shaped protrusions used to removably secure an amount of a user's hair to the attachment member.

10 Claims, 5 Drawing Sheets

FORCED AIR HAIR CURLER KIT

BACKGROUND OF THE INVENTION

Various types of hair drying and curling devices are known in the prior art. However, what is needed is a forced air hair curler kit that includes

FIELD OF THE INVENTION

The present invention relates to hair styling devices, and more particularly, to a forced air hair curler kit for forming multiple individual curls, the kit including a housing which houses a motor, a fan, and a pair of heating elements therein, two different types of support bodies that attach to a housing front end, and two versions of attachment members each of which fit onto a different one of the support body types, the attachment members having alternating rows of air outlet holes through which heated airflow exits and rows of cone-shaped protrusions used to removably secure an amount of a user's hair to the attachment member.

SUMMARY OF THE INVENTION

The general purpose of the present forced air hair curler kit, described subsequently in greater detail, is to provide a forced air hair curler kit which has many novel features that result in a forced air hair curler kit which is not anticipated, rendered obvious, suggested, or even implied by prior art, either alone or in combination thereof. To accomplish this, the present forced air hair curler kit is used to form multiple individual curls. The kit includes a hollow elongated tubular housing with screened air intake openings in a rear end and a screened annular inner frame attached to an open front end. An electric motor, a fan, and a pair of heating elements in operational communication are disposed within the housing. An on-off switch controls the motor and a dual temperature switch controls the heat discharged. An elongated support body fixedly attaches to the front end and releasably engages an attachment member, which is used to curl an individual's hair. One type of support body is elongated prolate hemisphere-shaped and includes a plurality of elongated flexible thin outer prongs having a proximal end attached to the inner frame and a distal end as well as a flexible center prong having an inner end attached to the front end central wall and also having an outer end. This type of support body also includes a thin annular outer frame having a smaller diameter than a diameter of the inner frame attached perpendicular to the distal end of the outer prongs and the outer end of the center prong. An orifice is centrally disposed within the outer frame with a plurality of parallelepiped spokes radially extending therefrom. The outer and center prongs may be formed of flexible metal wire or other sturdy and also flexible material, which will expand and retract. The other type of support body is an elongated cylinder having a rearward end fixedly attached to a central wall of the support body front end and a forward end.

The present forced air hair curler kit also includes two different versions of elongated tubular attachment members, each of which releasably engage the support body. Both versions of attachment members have an outer surface, an outside edge, an inside edge, an internal cavity, a plurality of spaced apart longitudinally aligned air outlet holes disposed throughout the outer surface to form a row of air outlet holes and a plurality of spaced apart longitudinally aligned cone-shaped protrusions extending outwardly from the entire outer surface forming a row of cone-shaped protrusions. Rows of the air outlet holes and the protrusions are alternatingly disposed on the outer surface of each attachment member. The cone-shaped protrusions secure a user's hair to the attachment member. Air passing into the interior cavity through the air intake openings is forced by the motor-powered fan over the heating elements and exits through the air outlet holes onto a desired portion of a user's hair to form a curl. One version of attachment member, which attaches to the support body having prongs, further includes a pair of thin elongated parallel slots longitudinally disposed through the outer surface of the attachment member, each of the slots releasably retaining one of the outer prongs of the support body. The internal cavity of each attachment member alternately, removably, slidingly engages the entire support body of the type that includes the outer prongs which expand and retract to allow the outer prongs to be releasably retained by the slots without breaking. The other attachment member version does not include the slots, but instead further includes a concentric second inside cavity centrally disposed within internal cavity and having a continuous exterior wall and a plurality of spaced apart parallelepiped strut members longitudinally disposed between an entire length of second inside cavity and an entire length of the internal cavity. The strut members radially extend from the second inside cavity exterior wall. The strut members provide additional support and strength to exterior wall as well as to the attachment member as a whole. In this other version, the second inside cavity of the attachment member removably, slidingly engages the entire support body that is a cylinder.

The attachment member further has a longer first type and a shorter second type. The first type has a length in a range of approximately 2 inches to 3 inches, while the second type has a length in a range of approximately 1 inch to 1¾ inch. A lock-release button disposed on the outer wall of the housing proximal to the front end alternately secures and releases the attachment member to and from the support body, respectively.

To use the present forced air hair curler kit, the user selects a first type or second type of attachment member that will releasably slidably attach over the support body. The user then wraps a portion of hair over the attachment member and turns the motor on using the on-off switch. The user may select a desired Hi or Lo temperature using the temperature control switch. The user may leave each attachment member The user may release each attachment member from the support body by pushing the lock-release button and leave each of the attachment members in place on the user's hair to form a curl. A period of ten minutes is recommended for leaving the attachment member in place. Then the user unwinds the attachment member from the hair.

Each support body and each attachment member may be thoroughly cleaned to maintain proper hygiene. The present kit may also include six to 8 interchangeable attachment members.

The present kit does not require a long initial heat-up period as do conventional heated roller assemblies. The attachment members may be provided in a wide range of other sizes apart from those mentioned herein.

Thus has been broadly outlined the more important features of the present forced air hair curler kit so that the detailed description thereof that follows may be better understood and in order that the present contribution to the art may be better appreciated.

Numerous objects, features and advantages of the present forced air hair curler kit will be readily apparent to those of ordinary skill in the art upon reading the following detailed description of presently preferred, but nonetheless illustrative, examples of the present forced air hair curler kit when taken in conjunction with the accompanying drawings. In this respect, before explaining the current examples of the present forced air hair curler kit in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the forced air hair curler kit. It is therefore important that the claims be regarded as including such equivalent constructions insofar as they do not depart from the spirit and scope of the present invention.

Objects of the present forced air hair curler kit, along with various novel features that characterize the invention are particularly pointed out in the claims forming a part of this disclosure. For better understanding of the forced air hair curler kit, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
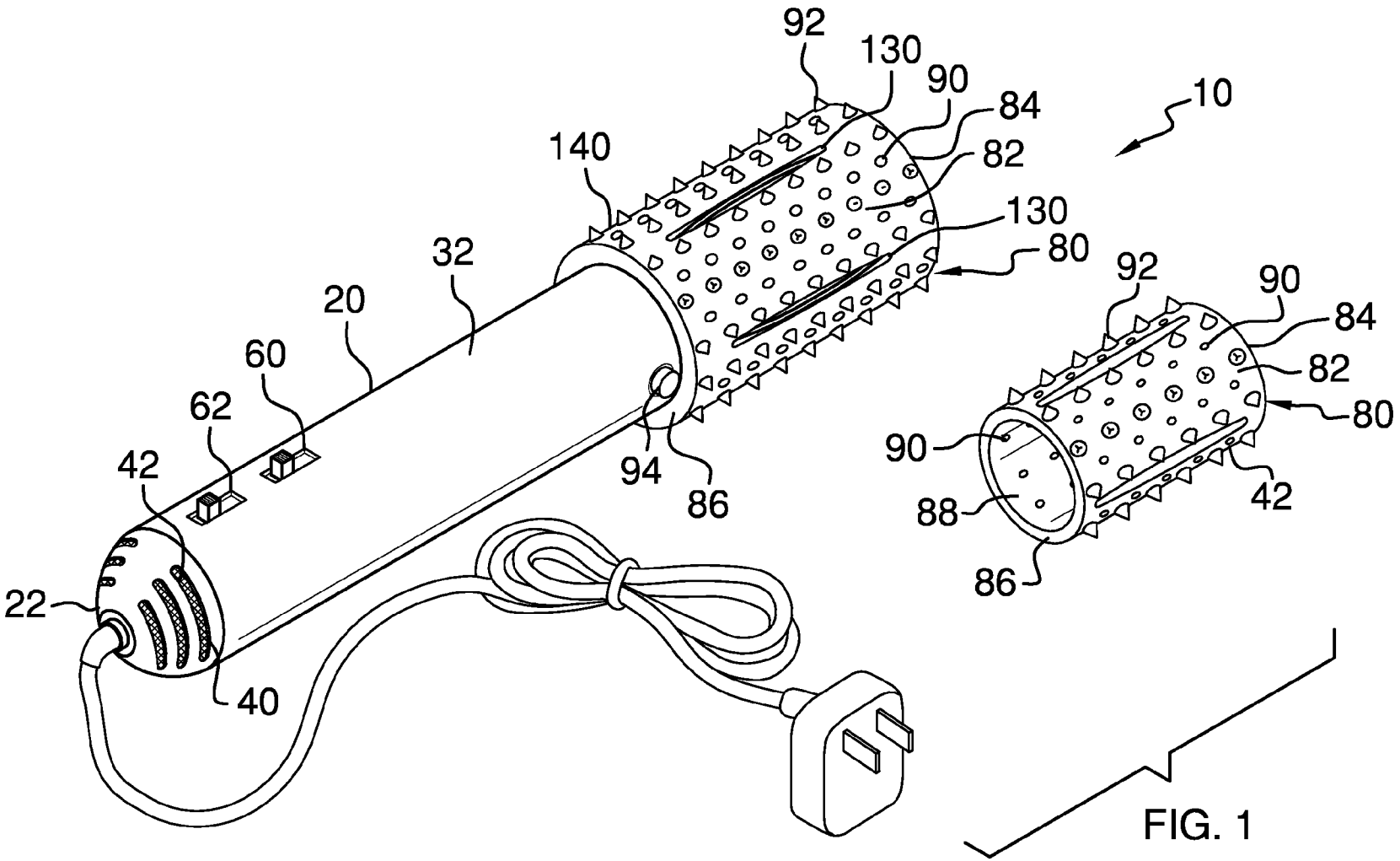
FIG. 1 is an isometric rear view.

With reference now to the drawings, and in particular FIGS. 1 through 5 thereof, example of the instant forced air hair curler kit employing the principles and concepts of the present forced air hair curler kit and generally designated by the reference number 10 will be described.

Referring to FIGS. 1 through 5 a preferred embodiment of the present forced air hair curler kit 10 is illustrated. The forced air hair curler kit 10 includes a hollow elongated tubular housing 20 having a rear end 22, a front end 24, a first aperture 26 disposed in the front end 26, a central wall 28 centrally disposed in the front end 24, a second aperture 30 disposed in the front end 24 on an opposite side of the central wall 28 from the first aperture 26, a continuous outer wall 32, and an interior cavity 34 defined by the rear end 22, the front end 24, and the outer wall 32. A thin annular inner frame 36 is attached to the front end 24 and surrounds the first aperture 26. A first screen 38 is disposed within the inner frame 36 and covers the entire first aperture 26. The first screen 38 permits airflow therethrough. A plurality of spaced apart air intake openings 40 is disposed on the rear end 22. Each air intake opening 40 has an internal second screen 42 thereacross. The second screen 42 also permits airflow therethrough.

An electric motor 50 is disposed within the interior cavity 34 proximal to the rear end 22. A fan 52 centrally disposed within the interior cavity 34 is in operational communication with the electric motor 50. A pair of elongated heating elements 54 are also disposed within the interior cavity 34 proximal to the front end 24 and to an inner wall 56 of the interior cavity 34. The heating element 54 are also in operational communication with the motor 50 and the fan 52. An on-off switch 60 disposed on the outer wall 32 is in operational communication with the motor 50. The on-off switch 60 alternately activates and deactivates the motor 50 when the on-off switch 60 is in an "on" position and an "off" position, respectively. A dual temperature switch 62 is disposed on the outer wall 32 proximal to the on-off switch 60. The temperature switch 62 is in operational communication with the motor 50. The temperature switch 62 alternately increases and decreases energy distributed from the motor 50 to the heating elements 34 when the temperature switch 62 is in a "Hi" position and a "Lo" position, respectively, which in turn, alternately increases and decreases the temperature of the heating elements 54.

The present forced air hair curler kit 10 also includes an elongated support body 75 fixedly attached to the front end 24 of the housing 20 in axial alignment with the front end 24. The kit 10 provides two types of flexible support bodies 75, each of which releasably engages an attachment member 80, which is used to curl an individual's hair. One type of support body 75 is elongated prolate hemisphere-shaped and includes a plurality of elongated flexible thin outer prongs 100 having a proximal end 102 attached to the inner frame 36 and a distal end 104 as well as a flexible center prong 106 having an inner end 108 attached to the front end 24 central wall 28 and also having an outer end 110. This type of support body 75 also includes a thin annular outer frame 115 having a smaller diameter than a diameter of the inner frame 36 attached perpendicular to the distal end 104 of the outer prongs 100 and the outer end 110 of the center prong 106. An orifice 117 is centrally disposed within the outer frame 115. A plurality of parallelepiped spokes 118 is disposed within the orifice 117. The spokes 118 radially extend from the center prong 106 outer end 110. The outer and center prongs 100, 106 may be formed of flexible metal wire or other sturdy and also flexible material, which will expand and retract.

Figure 2:
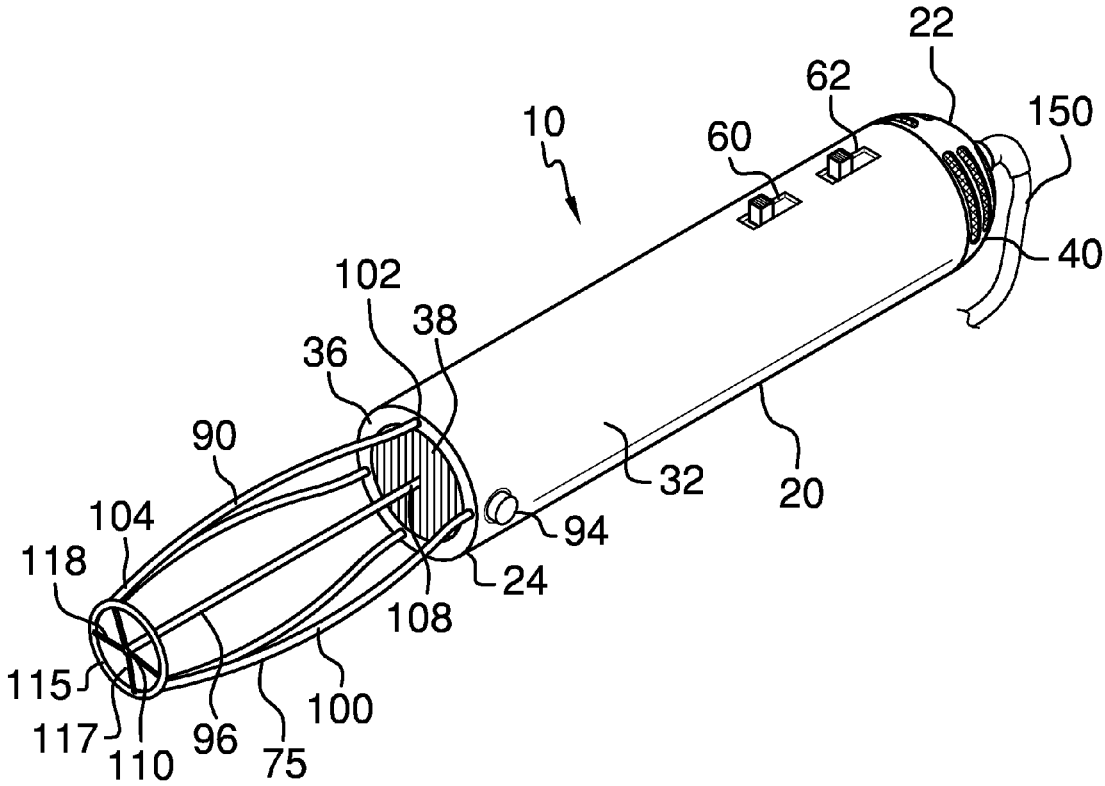
FIG. 2 is an isometric front view.
Figure 2A:
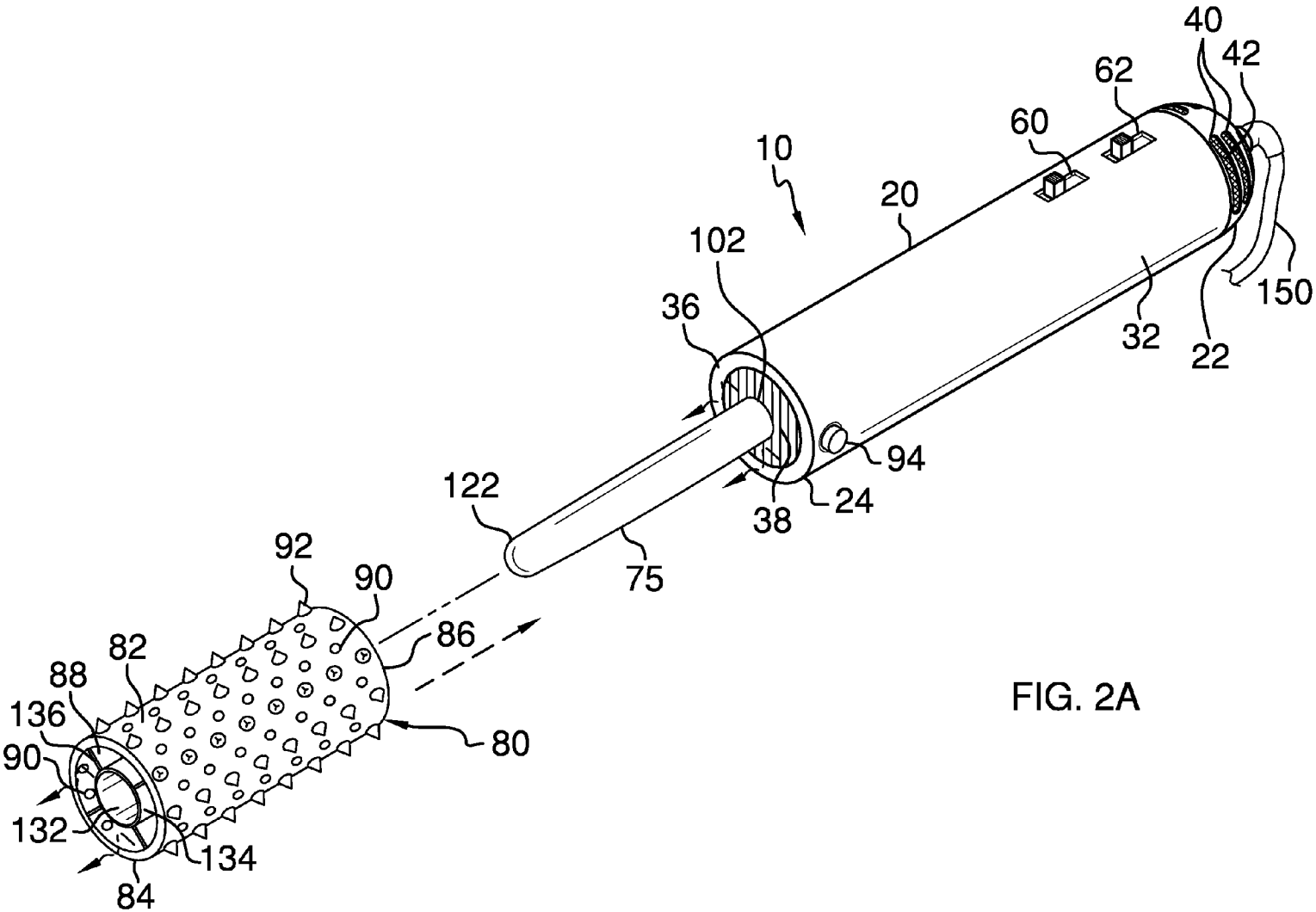
FIG. 2A is an isometric front view of another embodiment.
Figure 3:
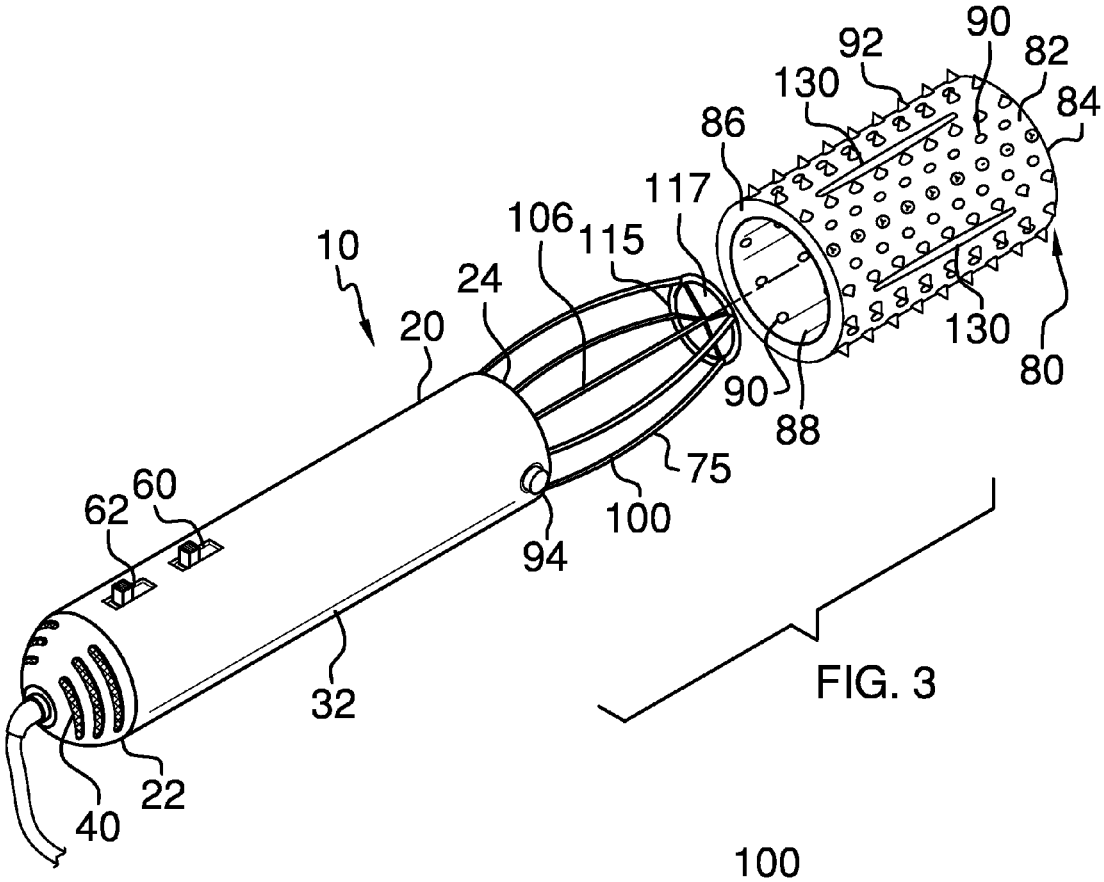
FIG. 3 is an exploded isometric rear view.
Figure 4:
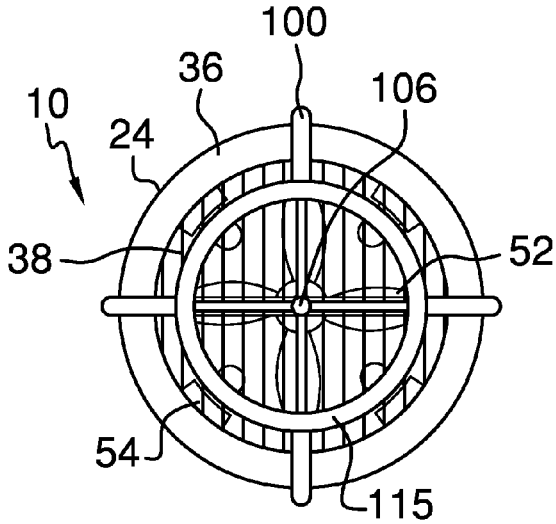
FIG. 4 is a front elevation view.
Figure 5:
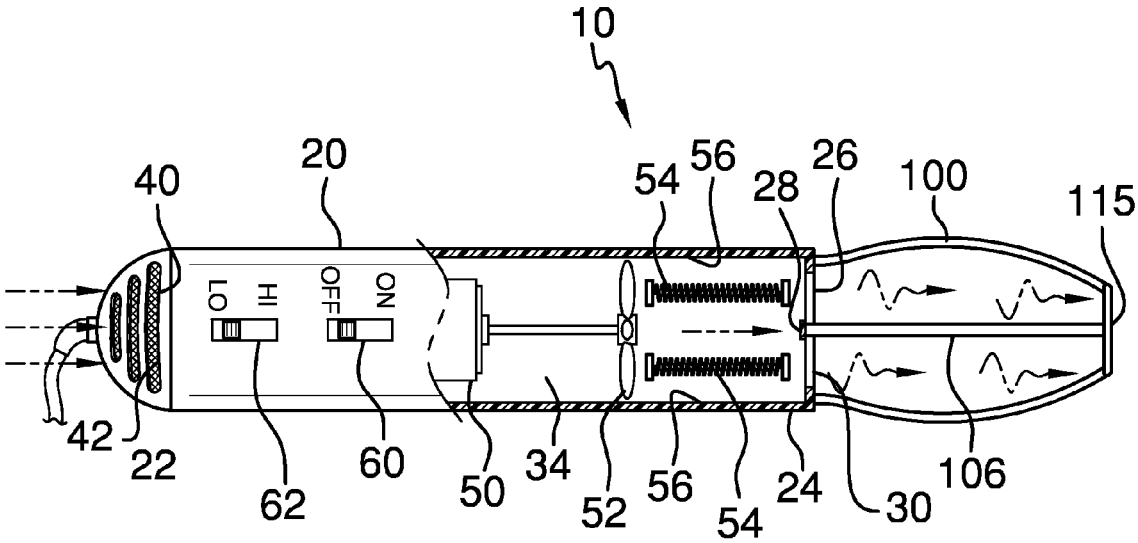
FIG. 5 is a side elevation view.

The other type of support body 75 is an elongated cylinder having a rearward end 120 fixedly attached to the central wall 28 of the support body 75 and a forward end 122, as shown in FIG. 2A.

The present forced air hair curler kit 10 also includes two different versions of elongated tubular attachment members 80, each of which releasably engage the support body 75. Both versions of attachment members 80 have an outer surface 82, an outside edge 84, an inside edge 86, and an internal cavity 88 defined by the outer surface 82, the outside edge 84, and the inside edge 86. Both versions of attachment members 80 also have a plurality of spaced apart longitudinally aligned air outlet holes 90 disposed throughout the outer surface 82 forming a row of air outlet holes 90 and a plurality of spaced apart longitudinally aligned cone-shaped protrusions 92 extending outwardly from the entire outer surface 82 forming a row of cone-shaped protrusions 92. Rows of the air outlet holes 90 and the protrusions 92 are alternatingly disposed on the outer surface 82 of each attachment member 80. The cone-shaped protrusions 92 removably secure an amount of the user's hair to the attachment member 80. Air passing into the interior cavity 34 through the air intake openings 40 is forced by the fan 52 over the heating elements 54 and out through the air outlet holes 90. Thus, when a section of an individual's hair is positioned around attachment member 80 while the motor 50 is activated, the air heats as the air passes over the heating element 54 and stays heated as the air passes through the air outlet holes 90 onto the section of hair, which in turn, dries and curls the section of hair.

One of the attachment member 80 versions also includes a pair of thin elongated parallel slots 130 longitudinally disposed through the outer surface 82 of the attachment member 80. Each of the slots 80 releasably retains one of the outer prongs 100 of the support body 75. The internal cavity 88 of each attachment member 80 alternately, removably, slidingly engages the entire support body 75 of the type that includes the outer prongs 100 which expand and retract to allow the outer prongs 100 to be releasably retained by the slots 130 without breaking.

The other attachment member 80 version does not include the slots 80, but instead further includes a concentric second inside cavity 132 centrally disposed within internal cavity 88 and having a continuous exterior wall 134 and a plurality of spaced apart parallelepiped strut members 136 longitudinally disposed between an entire length of the second inside cavity 132 and an entire length of the internal cavity 88. The strut members 136 radially extend from the second inside cavity 132 exterior wall 134. The strut members 136 provide additional support and strength to exterior wall 134 as well as to the attachment member 75 as a whole. In this other version, the second inside cavity 132 of the attachment member 80 removably, slidingly engages the entire support body 75 that is a cylinder.

The attachment member 75 further includes a first type 140 and a second type 142. The first type 140 has a greater length than a length of the second type 142. The attachment member 75 first type 140 has a length in a range of approximately 2 inches to 3 inches, while the attachment member 75 second type 142 has a length in a range of approximately 1 inch to 1¾ inch.

The present forced air hair curler kit 10 also includes a lock-release button 94 disposed on the outer wall 32 of the housing 20 proximal to the front end 24. The lock-release button 94 alternately secures and releases the attachment member 80 from the support body 75.

Use:

To use the present forced air hair curler kit 10 which includes a support member 75 either having outer prongs 100 or having a cylindrical shape, a user selects one of the first type 140 and second type 142 of attachment member 80. Selection of either the first type 140 or second type 142 depends on the amount of hair to be curled with a single attachment member 80. Next the user removably slides the internal cavity of the attachment member 80 over the entire support body 75 in the case of a prong-type support member or slides the second inside cavity over the entire support body 75 in the case of a cylindrical support boy 75. The user wraps an amount of the user's hair around the attachment member 80 and slides the on-off switch 60 into the "on" position to form a curl. The user may position the temperature switch 62 into a "Hi" position or a "Lo" position. The user then releases the attachment member 80 from the support body 75 by pressing the lock-release button 94, thus leaving the attachment member 80 in place with the user's hair wrapped around the attachment member 80 for a period of time allowing the attachment member 80 to cool. A period of ten minutes is recommended before unwinding each formed curl from each attachment member 80.

With respect to the above description then, it is to be realized that the optimum dimensional relationships for the parts of the present forced air hair curler kit to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A forced air hair curler kit for forming multiple individual hair curls, the kit comprising:

a hollow elongated tubular housing having a rear end, a front end, a first aperture disposed in the front end, a central wall centrally disposed in the front end, a second aperture disposed in the front end on an opposite side of the central wall from the first aperture, a continuous outer wall, and an interior cavity defined by the rear end, the front end, and the outer wall;

a thin annular inner frame attached to the front end and surrounding the first aperture;

a first screen disposed within the inner frame, the screen covering the entire first aperture, wherein the first screen permits airflow therethrough;

a plurality of spaced apart air intake openings disposed on the rear end, each air intake opening having an internal second screen thereacross, wherein the second screen permits airflow therethrough;

an electric motor disposed within the interior cavity proximal to the rear end;

a fan centrally disposed within the interior cavity, the fan in operational communication with the electric motor;

a pair of elongated heating elements disposed within the interior cavity proximal to the front end and to an inner wall of the interior cavity, the heating elements in operational communication with the motor and the fan;

an on-off switch disposed on the outer wall, the on-off switch in operational communication with the motor, wherein the on-off switch alternately activates and deactivates the motor when the on-off switch is in an "on" position and an "off" position, respectively;

a dual temperature switch disposed on the outer wall proximal to the on-off switch, the temperature switch in operational communication with the motor, wherein the temperature switch alternately increases and decreases energy distributed from the motor to the heating elements when the temperature switch is in a "Hi" position and a "Lo" position, respectively, whereby temperature of the heating elements is alternately increased and decreased, respectively;

an elongated support body fixedly attached to the front end of the housing, the support body disposed in axial alignment with the housing front end;

at least one elongated tubular attachment member releasably engaging the support body, each attachment member comprising:

an outer surface;

an outside edge;

an inside edge;

an internal cavity defined by the outer surface, the outside edge, and the inside edge;

a plurality of spaced apart longitudinally aligned air outlet holes disposed throughout the outer surface;

a plurality of spaced apart longitudinally aligned cone-shaped protrusions extending outwardly from the entire outer surface;

wherein the air outlet holes and the protrusions are alternatingly disposed on the outer surface of each attachment member;

a lock-release button disposed on the outer wall of the housing proximal to the front end, the lock-release button alternately securing and releasing the attachment member from the support body;

wherein air passing into the interior cavity through the air intake openings is forced by the fan over the heating elements and out through the air outlet holes.

2. The forced air curler kit of claim 1 wherein the support body is flexible and elongated prolate hemisphere-shaped and comprises:

a plurality of elongated flexible thin outer prongs having a proximal end attached to the inner frame and a distal end;

a flexible center prong having an inner end attached to the front end central wall and an outer end;

a thin annual outer frame having a smaller diameter than a diameter of the inner frame, the outer frame attached perpendicular to the distal end of the outer prongs and the outer end of the center prong;

an orifice centrally disposed within the outer frame;

a plurality of spokes disposed within the orifice, the spokes radially extending from the center prong outer end.

3. The forced air hair curler kit of claim 2 wherein each attachment member further comprises:

a pair of thin elongated parallel slots longitudinally disposed through the outer surface of the attachment member;

wherein each of the slots releasably retain one of the outer prongs of the support body;

wherein the internal cavity of each attachment member alternately, removably, slidingly engages the entire support body.

4. The forced air hair curler kit of claim 3 wherein the attachment member further comprises a first type and a second type, wherein the first type has a greater length than a length of the second type.

5. The forced air hair curler kit of claim 4 wherein the attachment member first type has a length in a range of approximately 2 inches to 3 inches and the attachment member second type has a length in a range of approximately 1 inch to 1¾ inch.

6. The forced air hair curler kit of claim 2 wherein each attachment member further comprises:

a concentric second inside cavity centrally disposed within internal cavity and having a continuous exterior wall;

a plurality of spaced apart parallelepiped strut members longitudinally disposed between an entire length of the second inside cavity and an entire length of the internal cavity, the strut members radially extending from the second inside cavity exterior wall;

wherein the second inside cavity of each attachment member removably, slidingly engages the entire support body.

7. The forced air hair curler kit of claim 6 wherein the attachment member further comprises a first type and a second type, wherein the first type has a greater length than a length of the second type.

8. The forced air hair curler kit of claim 7 wherein the attachment member first type has a length in a range of approximately 2 inches to 3 inches and the attachment member second type has a length in a range of approximately 1 inch to 1¾ inches.

9. The forced air hair curler kit of claim 1 wherein the support body is an elongated cylinder having a rearward end fixedly attached to the central wall and a forward end.

10. The forced air hair curler kit of claim 9 wherein the support body is formed of metal wire.

* * * * *